United States Patent [19]

Adamek et al.

[11] Patent Number: 4,911,245

[45] Date of Patent: Mar. 27, 1990

[54] METAL SEAL WITH SOFT INLAYS

[75] Inventors: Frank C. Adamek, Pasadena; Charles D. Bridges; Anton J. Dach, both of Houston, all of Tex.

[73] Assignee: Vetco Gray Inc., Houston, Tex.

[21] Appl. No.: 321,964

[22] Filed: Mar. 10, 1989

[51] Int. Cl.[4] ..... E21B 33/04

[52] U.S. Cl. ..... 166/387; 166/82; 166/84; 277/208; 277/236

[58] Field of Search ..... 166/208, 217, 115, 182, 166/387, 84, 82; 277/208-210, 236, 123-125; 285/143, 146, 917, 141

[56] References Cited

U.S. PATENT DOCUMENTS

| | | | |
|---|---|---|---|
| 4,302,018 | 11/1981 | Harvey et al. | 277/236 X |
| 4,470,609 | 9/1984 | Poe | 277/170 |
| 4,588,029 | 5/1986 | Blizzard | 166/120 |
| 4,665,979 | 5/1987 | Boehm, Jr. | 166/208 |
| 4,749,035 | 6/1988 | Cassity | 166/120 |
| 4,771,832 | 9/1988 | Bridges | 166/380 |

FOREIGN PATENT DOCUMENTS

| | | | |
|---|---|---|---|
| 1141254 | 2/1985 | U.S.S.R. | 277/236 |

*Primary Examiner*—Hoang C. Dang
*Attorney, Agent, or Firm*—James E. Bradley

[57] ABSTRACT

A metal seal for sealing against casing in a well has a plurality of circumferentially axially spaced metal bands. An inlay material partially fills the cavities located between the metal bands. The metal bands are soft enough to deform when the seal is pressed into contact with the casing. The bands deform to a point flush with the inlay material. If the casing later moves axially relative to the seal because of temperature change or tension loading, then the inlay material will wipe across the band faces to maintain the seal.

4 Claims, 2 Drawing Sheets

METAL SEAL WITH SOFT INLAYS

BACKGROUND OF THE INVENTION

1. Field of the Invention:

This invention relates to casing seals for wellheads, and in particular to a metal seal for sealing between the casing and the wellhead bore.

2. Description of the Prior Art:

In a completed oil or gas well, one or more strings of casing is cemented in the well. A wellhead is located at the surface for supporting the upper end of the casing. The wellhead includes a lower portion through which the casing extends. A casing hanger supports the casing in the lower portion of the wellhead.

In one technique, the casing hanger fits around the casing, and the upper end of the casing will be cut off a selected distance above the wellhead after cementing. A casing seal or packoff will be placed between the casing and the bore of an upper portion of the wellhead. This packoff prevents leakage from the annulus between the casing and the wellhead.

In many wells, the produced fluid will be at a fairly warm temperature as it reaches the surface of the casing. The warm temperature can cause the casing to expand axially. The wellhead, however, will not move axially. This results in a slight amount of axial movement of the casing relative to the wellhead.

In the past, elastomeric seals were used as packoffs primarily. These seals would tolerate a slight amount of axial movement of the casing relative to the wellhead. However, metal seals are now preferred for many oil field applications. Metal seals are longer lasting and are not subject to deterioration from certain well fluids to the extent that elastomeric seals may be. However, a metal seal requires a very precise fit in order to accomplish sealing. Also, axial movement would damage the sealing ability of the metal seal.

In U.S. Pat. No. 4,711,832, Charles D. Bridges, Sep. 20, 1988, a metal seal is illustrated for sealing between casing and the wellhead. The metal seal includes two eccentric rings. These rings can be rotated to accommodate slight misalignment of the axis of the casing relative to the axis of the wellhead. The inner sealing ring has an inner face that seals against the exterior of the casing. This inner face contains bands that are axially spaced apart. The bands are soft enough to deform when the seal ring is pressed into contact with the casing.

While this type of arrangement is satisfactory for a static seal, axial movement of the casing relative to the ring can cause problems. It could damage the seal face on the seal bands, destroying the effectiveness of the seal.

SUMMARY OF THE INVENTION

In this invention, a metal ring is provided with a sealing side that faces the cylindrical member such as the casing. The ring has a plurality of circumferential axially spaced metal bands that protrude from the sealing side. These bands define cavities between them. An inlay of soft metal is located in these cavities.

When the seal is energized into sealing contact with the casing, the bands will deform and flatten. Preferably, the inlay material partially fills the cavities. When the bands flatten, they will become substantially flush with the inlay material. Later, if the casing begins to move axially, the inlay material will wipe across the bands, maintaining the effectiveness of the seal.

DESCRIPTION OF THE PREFERRED EMBODIMENT

Figure 1:
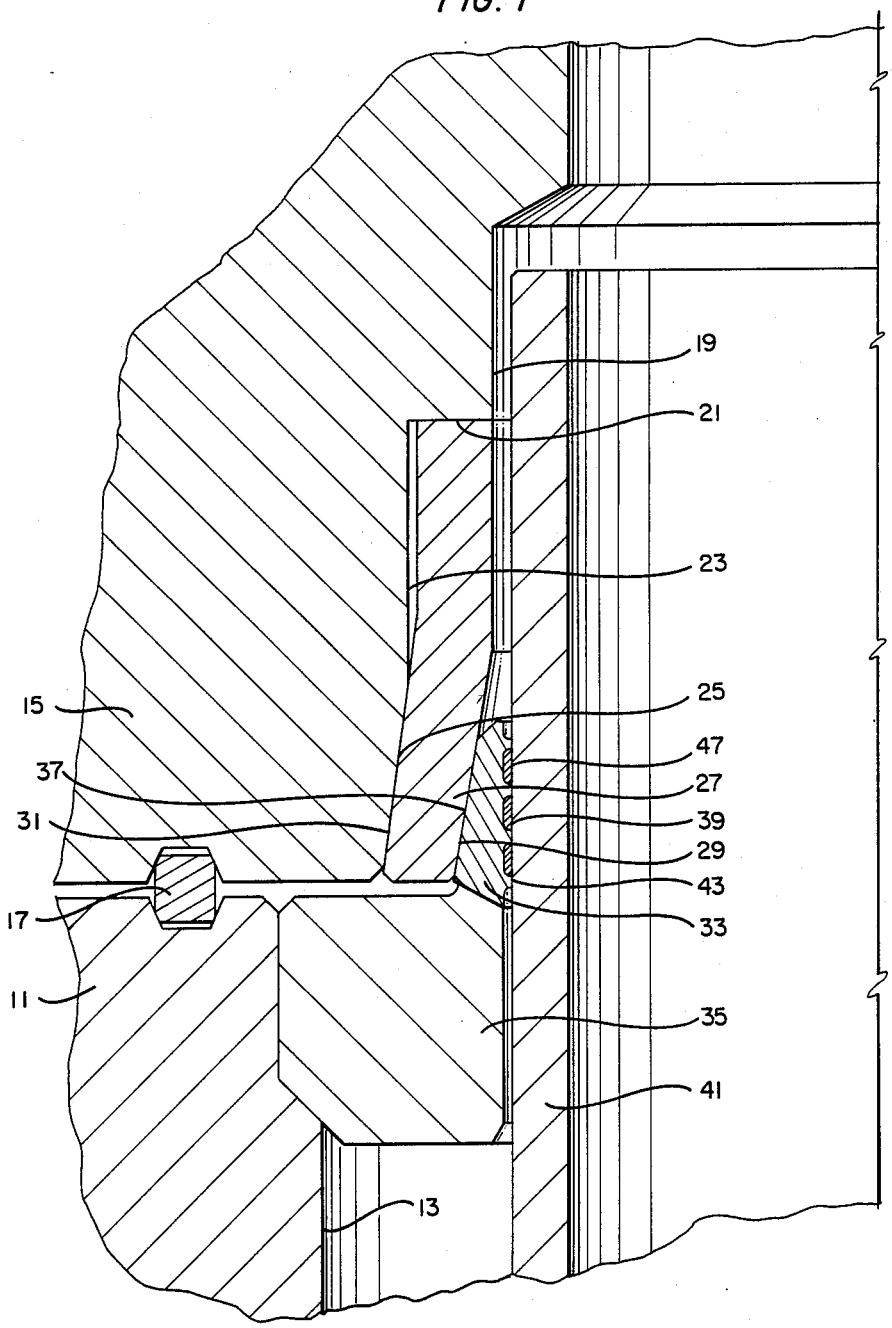
FIG. 1 is a partial sectional view illustrating a seal constructed in accordance with this invention.

Referring to FIG. 1, the well has a lower wellhead 11 which has a bore 13. An upper wellhead 15 secures to the lower wellhead 11 by means of flanges (not shown) which bolt together. A seal 17 locates between the faces of the upper and lower wellheads 15, 11. Upper wellhead 15 has a bore 19 that is co-axial with bore 13.

The bore 19 includes an enlarged counterbore 23. The junction between the counterbore 23 and the bore 19 results in a downward facing shoulder 21. Counterbore 23 includes a lower tapered section 25 that diverges in a downward direction.

A wedge ring 27 locates within the counterbore 23. Wedge ring 27 has an upper end that will contact the shoulder 21. Wedge ring 27 has a lower section that is conical both on the inner side 29 and the outer side 31. The taper of the outer side 31 matches that of the counterbore tapered section 25. The upper portion of the wedge ring 27 is cylindrical. A seal ring 33 locates within the inside of the wedge ring 27.

Seal ring 33 will rest on top of a test ring 35. Test ring 35 locates in the upper portion of the lower wellhead 11. Seal ring 33 has a tapered outer side 37. The taper of the outer side 37 matches that of the taper of the inner side 29 of the wedge ring 27. Seal ring 33 has an inner side 39 that is cylindrical for sealing on the exterior of casing 41. The casing 41 extends substantially coaxial through the bores 13, 19.

Figure 2:
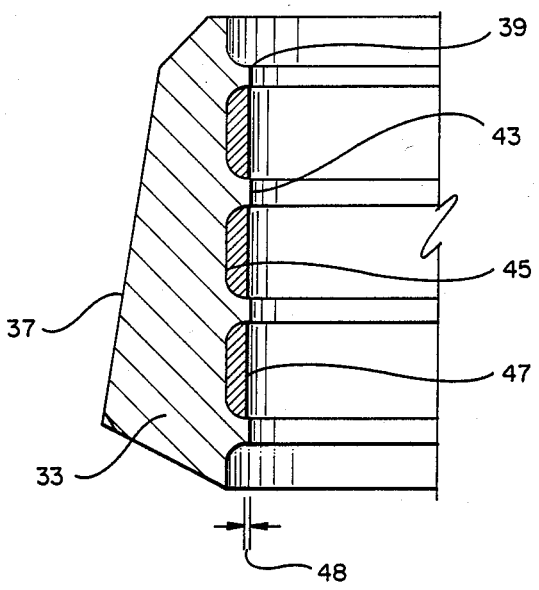
FIG. 2 is an enlarged sectional view of the seal of FIG. 1.

Referring to FIG. 2, a plurality of bands 43 protrude radially inward from the seal ring inner side 39. Bands 43 are circumferential and axially spaced apart even distances. The sealing face or inner side of each band 43 is cylindrical.

The bands 43 define cavities 45 between them. An inlay 47 of soft metal partially fills each cavity 45. Prior to energizing, the bands 43 will protrude a slight distance radially inward of the interior surface of the inlay 47. This results in a slight clearance 48. When the bands 43 first touch the casing 41, the clearance 48 will exist between the inlays 47 and the casing 41. The bands 43 preferably protrude from the cavities 45 about .040 inch. The clearance 48 between the sealing surface of the bands 43 and the interior surface of the inlay 47 is preferably about .015 to .020 inch.

The material of the seal ring 33 is softer than the casing 41. Typical casing may have a yield strength of 55,000 to 60,000 psi. Preferably, the yield strength of the seal ring 33 will be about half of the yield strength of the casing 41. The material of the inlay 47 is much softer than the material of the seal ring 33. It will be a lubricating type material such as a tin indium alloy. Other suitable alloys including cadmium or lead could also be used. The hardness of the inlay 47 will be only about 25 percent of the hardness of the seal ring 33 material.

Preferably, the seal ring 33 and the wedge ring 27 are eccentric and constructed as described in more detail in U.S. Pat. No. 4,771,832, all of which material is hereby incorporated by reference.

In operation, the casing 41 will be cemented in place. A casing hanger (not shown) will be then positioned between the casing 41 and the lower wellhead 11 to support the casing. The test ring 35 will be positioned in place. The upper end of the casing 41 will be cut off a selected distance above the lower wellhead 11.

The exterior of the casing 41 above the test ring 35 will be wire brushed and smoothed with emery cloth. The seal ring 33 and wedge ring 27 are placed over the casing 41. Both rings 27 and 33 may be rotated, but normally only one of the rings will be rotated. Rotation will be performed until the centerline of the seal ring 33 coincides with the axis of the lower wellhead 11.

Once aligned, the upper wellhead 15 is bolted to the lower wellhead 11. The shoulder 21 bears down on the wedge ring 27. The wedge ring 27 pushes the seal ring 33 inward with great force. This causes the bands 43 to permanently flatten and deform. The bands 43 will flatten until they are substantially flush with the interior surface of the inlay 47, as shown in FIG. 1. The outer side 31 of the wedge ring 27 forms a tight metal seal with the lower tapered section 25. The inner side 29 of wedge ring 27 forms a tight metal seal with the seal ring tapered side 37.

Under certain conditions during production, the casing 41 may move up and down relative to the seal ring 33. The casing 41 may possibly move as much as one-fourth inch in one direction, and .050 inch in the reverse direction from the position that the casing 41 first acquired when the ring 33 was set. If this occurs, the inlay 47 will wipe into damaged areas of the seal bands 43. The cavities 45 serve as reservoirs to store up the inlay material 47 for wiping across the faces of the bands 43.

The invention has significant advantages. The metal seal ring will seal on casing that can move slight distances axially. The reservoir of inlay material produces a seal capable of withstanding this axial movement, which is generated by changes in temperature or tension load.

While the invention has been shown in only one of its forms, it should be apparent to those skilled in the art that it is not so limited, but is susceptible to various changes without departing from the scope of the invention.

We claim:

1. In an apparatus having a cylindrical member, an improved means for sealing against the cylindrical member, comprising in combination:

a metal ring having a sealing side facing the cylindrical member;

means for moving the sealing side into sealing contact with the cylindrical member;

the cylindrical member and the metal ring being capable of slight axial movement relative to each other after the sealing side is in sealing contact with the cylindrical member;

a plurality of circumferential axially spaced metal bands protruding radially from the sealing side, defining cavities between the bands, the bands being sufficiently softer relative to the cylindrical member to deform when forced into contact with the cylindrical member; and an inlay material of metal softer than the bands located in the cavities, the inlay material wiping onto the bands during said axial movement.

2. In an apparatus having a first member inserted within a second member, defining an annular space between the first and second members, an improved means for sealing the annular space, comprising in combination:

a metal ring having a first sealing side facing the first member and a second sealing side facing the second member;

a plurality of circumferential axially spaced metal bands protruding radially from the first sealing side, defining cavities between the bands, each of the bands having a cylindrical sealing surface;

the bands having a hardness that is less than the hardness of the first member;

an inlay material of metal softer than the bands located in and initially partially filling the cavities, the sealing surfaces of the bands initially located a selected radial distance past the exterior surfaces of the inlay material;

means for moving the first sealing side into contact with the first member and for sealingly contacting the second sealing side with the second member with a force sufficient to cause the bands to become substantially flush with the exterior surfaces of the inlay material when the ring is forced into contact with the first member; and the first member and ring being capable of slight axial movement relative to each other after the first sealing side is in sealing contact with the first member, with the inlay material wiping onto the bands during said axial movement.

3. In a well assembly having a wellhead containing a string of casing supported in the bore, an improved means for sealing against the casing, comprising in combination:

a metal ring having an inner sealing side facing the casing;

a plurality of circumferential axially spaced metal bands protruding radially inward from the inner sealing side, defining cavities between the bands, each of the bands having a cylindrical sealing surface;

the bands having a hardness that is less than the hardness of the casing;

an inlay material of metal softer than the bands located in and initially partially filling the cavities, the sealing surfaces of the bands initially located a selected distance radially inward from the exterior surfaces of the inlay material;

means for moving the inner sealing side into contact with the casing with a force sufficient to cause the bands to deform to a position substantially flush with the exterior surfaces of the inlay material when the ring is forced into contact with the casing; and the casing being movable relative to the ring is slight axial directions with the inlay material wiping onto the bands during said axial movement.

4. A method for sealing a cylindrical member, comprising in combination:

providing a metal ring having a sealing side facing the cylindrical member;

providing a plurality of circumferential axially spaced metal bands protruding radially from the sealing side, defining cavities between the bands, and providing each of the bands with a cylindrical sealing surface, the bands being softer than the cylindrical member;

partially filling the cavities with an inlay material of metal softer than the bands, with the sealing surfaces of the bands initially located a selected radial distance past the exterior surfaces of the inlay material;

pushing the sealing side into contact with the cylindrical member, deforming the bands substantially flush with the exterior surfaces of the inlay material; and allowing slight axial movement of the cylindrical member relative to the ring to occur, with the inlay material wiping onto the bands during said axial movement.

* * * * *